US006656093B2

(12) United States Patent
Chen

(10) Patent No.: US 6,656,093 B2
(45) Date of Patent: Dec. 2, 2003

(54) ADJUSTABLE DUMBBELL HAVING EASILY ADJUSTING STRUCTURE

(76) Inventor: Paul Chen, 7771 Goldstream Dr., Richmond, Vancouver, BC (CA), V7A 1S5

( * ) Notice: Subject to any disclaimer, the term of this patent is extended or adjusted under 35 U.S.C. 154(b) by 331 days.

(21) Appl. No.: 09/867,509

(22) Filed: May 31, 2001

(65) Prior Publication Data

US 2002/0183174 A1 Dec. 5, 2002

(51) Int. Cl.[7] ..... A63B 21/072
(52) U.S. Cl. ..... 482/108; 482/107; 482/908
(58) Field of Search ..... 482/93, 94, 106–109, 482/98, 908

(56) References Cited

U.S. PATENT DOCUMENTS

| | | | | |
|---|---|---|---|---|
| 4,529,198 A | * | 7/1985 | Hettick, Jr. | 482/104 |
| 4,566,690 A | | 1/1986 | Schook | 272/123 |
| 5,257,964 A | * | 11/1993 | Petters | 482/92 |
| 5,407,413 A | | 4/1995 | Kupferman | 482/106 |
| 5,839,997 A | * | 11/1998 | Roth et al. | 482/107 |
| 6,033,350 A | * | 3/2000 | Krull | 482/98 |
| 6,099,442 A | * | 8/2000 | Krull | 482/107 |
| 6,149,558 A | * | 11/2000 | Chen | 482/107 |
| 6,196,952 B1 | * | 3/2001 | Chen | 482/107 |
| 6,228,003 B1 | * | 5/2001 | Hald et al. | 482/107 |
| 6,402,666 B2 | * | 6/2002 | Krull | 482/107 |
| 6,416,446 B1 | * | 7/2002 | Krull | 482/108 |
| 6,422,979 B1 | * | 7/2002 | Krull | 482/98 |
| 6,500,101 B1 | * | 12/2002 | Chen | 482/107 |
| 6,540,650 B1 | * | 4/2003 | Krull | 482/107 |

FOREIGN PATENT DOCUMENTS

| | | | | |
|---|---|---|---|---|
| SU | 1618430 A | * | 1/1991 | 482/108 |

* cited by examiner

*Primary Examiner*—Jerome W. Donnelly
*Assistant Examiner*—Victor Hwang
(74) *Attorney, Agent, or Firm*—Charles E. Baxley

(57) ABSTRACT

An adjustable dumbbell includes one or more weights engaged onto a rod, and a latch slidably engaged in the rod and movable to engage with one or more of the weights for selectively or adjustably securing the weights to the rod. The weights each has a groove for receiving the rod, and each has a channel communicating with the groove for receiving the latch. A fastener is secured to the latch and slidably engaged in the rod for moving the latch relative to the rod. A barrel is slidably engaged on the fastener and a spring may bias the barrel to engage with the rod.

12 Claims, 2 Drawing Sheets

ADJUSTABLE DUMBBELL HAVING EASILY ADJUSTING STRUCTURE

BACKGROUND OF THE INVENTION

1. Field of the Invention

The present invention relates to a dumbbell, and more particularly to an adjustable dumbbell having an easily and quickly adjustable structure.

2. Description of the Prior Art

Various kinds of typical dumbbells have been developed. U.S. Pat. No. 4,566,690 to Schook, and U.S. Pat. No. 5,407,413 to Kupferman discloses two of the typical dumbbells each including one or more weight rings that may be selectively or adjustably secured together for adjusting the weight of the dumbbells.

In U.S. Pat. No. 4,566,690 to Schook, the weight rings each includes an outer thread for threading with the inner threads of the other weight rings and for securing the weight rings together. It takes time to thread the weight rings together.

In U.S. Pat. No. 5,407,413 to Kupferman, the weight rings are engaged on a core or a rod and each includes a number of posts for engaging into the holes of the other weight rings. It is also required to secure the weight rings one by one. In addition, the weight rings may be rotated and disengaged from each other while in use.

The present invention has arisen to mitigate and/or obviate the afore-described disadvantages of the conventional dumbbells.

SUMMARY OF THE INVENTION

The primary objective of the present invention is to provide an adjustable dumbbell including an easily and quickly adjustable structure.

In accordance with one aspect of the invention, there is provided an adjustable dumbbell comprising a rod including a first end, at least one weight engaged onto the first end of the rod, and a latch slidably engaged in the first end of the rod and movable to engage with the weight for selectively securing the weight to the first end of the rod.

The weight includes a groove formed therein for receiving the first end of the rod, the first end of the rod includes a pair of slots formed therein for receiving the weight.

The weight includes a channel formed therein and communicating with the groove thereof and having a width greater than that of the groove of the weight, for receiving the latch.

The first end of the rod includes a conduit formed therein for slidably receiving the latch. The first end of the rod includes a passage formed therein and communicating with the conduit thereof, the latch includes a fastener secured thereto and slidably engaged in the passage of the rod for moving the latch relative to the rod.

The first end of the rod includes at least one aperture formed therein and communicating with the passage of the rod, the latch further includes a barrel slidably engaged on the fastener and having a catch for engaging into the aperture of the rod.

A device may further be provided for biasing the catch of the barrel to engage with the aperture of the rod.

The rod includes a second end, at least one second weight engaged onto the second end of the rod, and a second latch slidably engaged in the second end of the rod and movable to engage with the second weight for selectively securing the second weight to the second end of the rod.

The second weight includes a groove formed therein for receiving the second end of the rod, the second end of the rod includes a pair of slots formed therein for receiving the second weight.

The second weight includes a channel formed therein and communicating with the groove thereof and having a width greater than that of the groove of the second weight, for receiving the second latch.

The second end of the rod includes a conduit formed therein for slidably receiving the second latch. The second end of the rod includes a passage formed therein and communicating with the conduit thereof, the second latch includes a fastener secured thereto and slidably engaged in the passage of the rod for moving the second latch relative to the rod.

The second end of the rod includes at least one second aperture formed therein and communicating with the passage of the rod, the second latch further includes a barrel slidably engaged on the fastener and having a catch for engaging into the second aperture of the rod. A device is further provided for biasing the catch of the barrel to engage with the second aperture of the rod.

A device is further provided for supporting the weight and includes a base having at least one socket recess formed therein for receiving and supporting the weight. The base includes at least one pair of walls provided therein for defining the socket recess therein.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
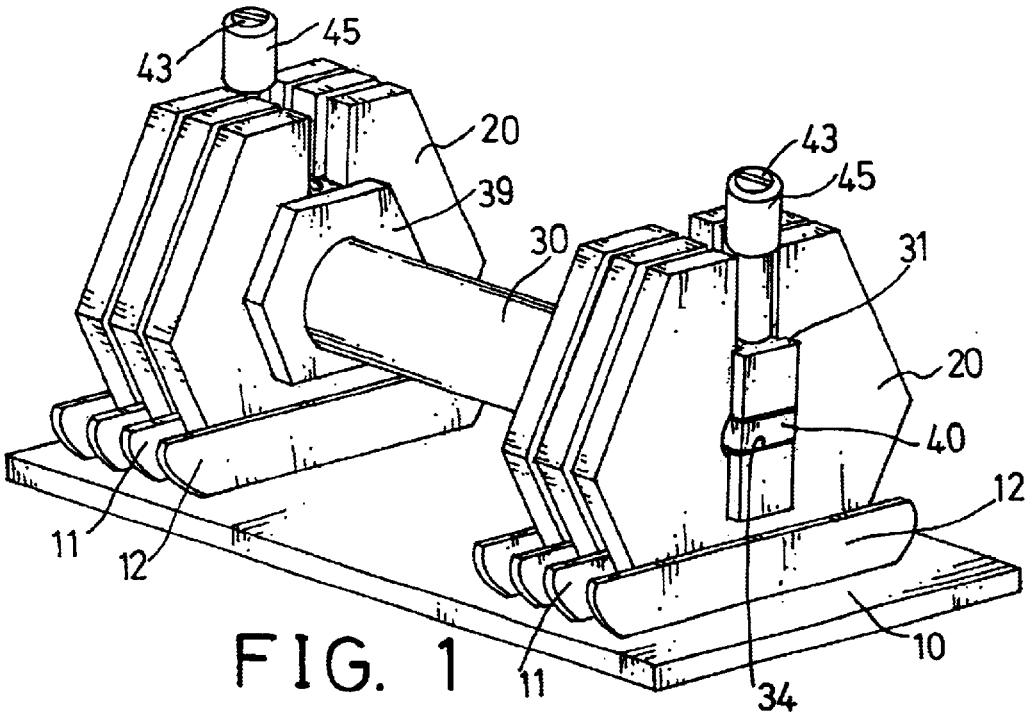
FIG. 1 is a perspective view of an adjustable dumbbell in accordance with the present invention.

Referring to the drawings, and initially to FIGS. 1–4, an adjustable dumbbell in accordance with the present invention comprises a base 10 including a number of socket recesses 11 formed in the upper portion thereof and formed and defined by a number of partitions or walls 12. A number of weights 20 each includes a lower portion engageable or receivable in the socket recesses 11 of the base 10, for allowing the weights 20 to be supported on the base 10 and to be supported in an erected position. The weights 20 each includes a groove, such as a vertical groove 21 formed therein and having an open top 23, and each includes a lateral channel 22 formed therein and communicating with or intersecting with the vertical groove 21 thereof. The lateral channel 22 of the weight 20 includes a width greater than that of the groove 21 of the weight.

Figure 3:
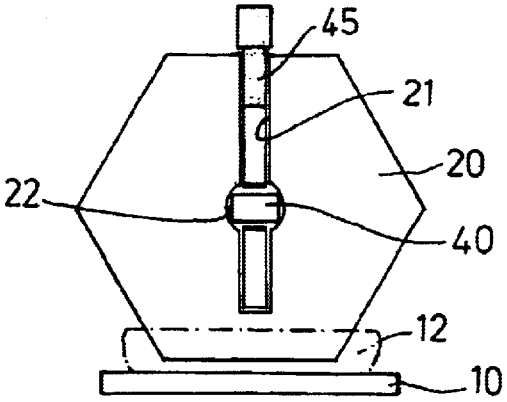
FIG. 3 is an end view of the adjustable dumbbell.
Figure 2:
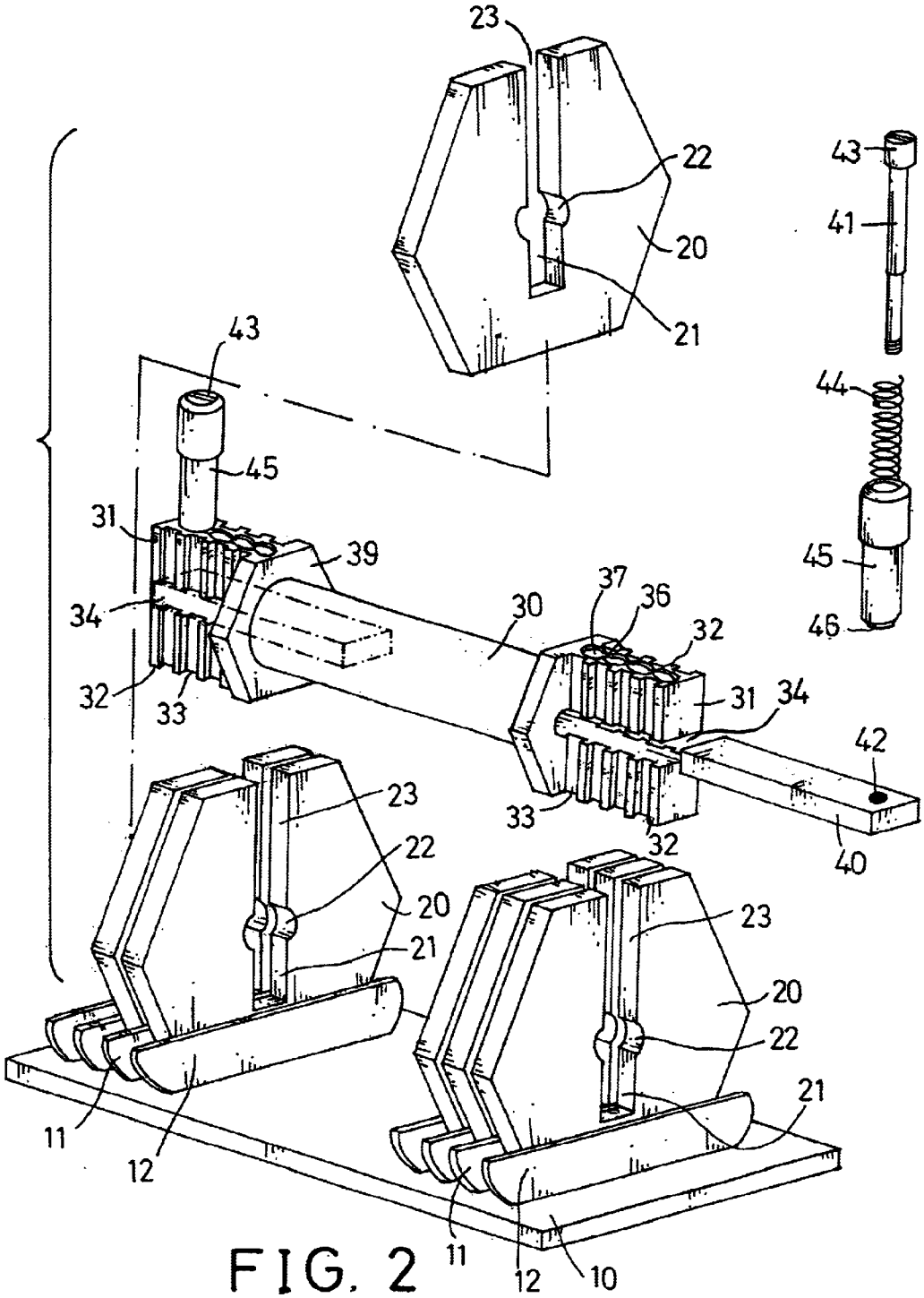
FIG. 2 is a partial exploded view of the adjustable dumbbell.

A rod 30 includes one or two ends each having a block 31 provided thereon for engaging into the grooves 21 of the weights 20, best shown in FIGS. 1 and 3. The blocks 31 each includes one or more pairs of slots 33 formed therein and defined by one or more pairs of projections 32, for receiving the weights 20 respectively, best shown in FIGS. 4, 5, and for stably retaining the weights 20 in the slots 33 of the block 31. The rod 30 includes one or both ends each having a conduit 34 laterally formed therein and preferably formed in the middle portion of the block 31. The conduits 34 of the rod 30 each includes a length greater than that of the blocks 31. The blocks 31 each includes a passage 36 formed therein and communicating with the conduit 34 thereof, and each includes one or more apertures 37 formed therein and spaced away from each other and communicating with the passage 36 of the blocks 31. The apertures 37 each includes a diameter greater than the width of the passage 36 of the block 31.

A latch 40 is slidably received in each of the conduits 34 of the blocks 31 and each includes a hole 42, such as a screw hole 42 formed therein, preferably formed in the outer end thereof. A fastener, such as a bolt 41 is slidably engaged through the passage 36 of each of the blocks 31 and is engaged into or threaded and secured to the screw hole 42 of the latch 40, such that the fastener 41 may be moved in concert with the latch 40, and such that the latches 40 may be moved relative to the blocks 31 respectively. The fasteners 41 each includes a head 43 provided on top thereof. The fasteners 41 are limited to slide and to move along the passages 36 of the blocks 31 respectively, such that the latches 40 may also be limited to move and to slide relative to the blocks 31 and may be prevented from being disengaged from the blocks 31 and the rod 30.

A barrel 45 is slidably engaged onto each of the fasteners 41 and each includes a catch 46 provided in the bottom thereof for engaging into the apertures 37 of the blocks 31 respectively. A spring 44 is received in and engaged with each of the barrels 45 for biasing the catches 46 of the barrels 45 to engage with either of the apertures 37 of the blocks 31, best shown in FIGS. 4, 5, and for selectively or adjustably securing the latches 40 to the blocks 31 respectively. The spring 44 may be engaged between the head 43 of the fastener 41 and a peripheral shoulder formed in the barrel 45, for biasing the catches 46 of the barrels 45 to engage with either of the apertures 37 of the blocks 31.

As best shown in FIG. 3, the latch 40 includes a width greater than that of the vertical grooves 21 of the weights 20, and equals to or smaller than that of the lateral channel 22 of the weight 20, such that the weights 20 may be secured to the block 31 when the latch 40 is engaged into the lateral channels 22 of the weights 20. The weights may thus be stably secured to the blocks 31 by the latch 40 and the projections 32 of the blocks 31.

Figure 5:
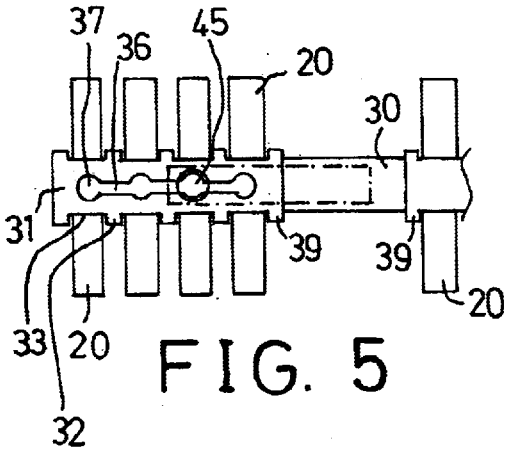
FIGS. 4 and 5 are partial top plane views illustrating the operation of the adjustable dumbbell.
Figure 4:
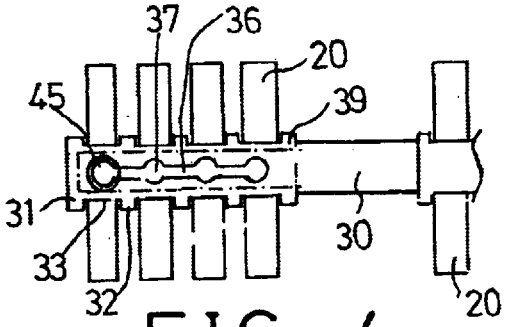

In operation, as shown in FIGS. 4 and 5, the latches 40 may be moved and adjusted relative to the blocks 31 respectively when the catches 46 of the barrels 45 are disengaged from the apertures 37 of the blocks 31 by pulling the barrels 45 away from the blocks 31 against the springs 44 respectively. For example, as shown in FIG. A, the latch 40 may be moved to engage into the lateral channels 22 of all of the weights 20, in order to secure all of the weights 20, such as four weights 20 to the block 31.

As shown in FIG. 5, the latch 40 may also be moved and adjusted to engage into the lateral channels 22 of some of the weights 20, such as two of the weights 20, in order to secure only the two weights 20 to the block 31. At this moment, when the rod 30 is pulled away from the base 10 or the weights 20, the block 31 may be moved outward of the vertical grooves21 of the outer two weights 20 via the open top 23 of the weights 20, such that the outer two weights 20 may still be supported on the base 10 and will not be moved away from the base 10 by the rod 30 and the block 31. Only the two inner weights 20 may be secured to the block 31 and moved away from the base 10 by the block 31 and the rod 30.

It is to be noted that the weights 20 may also be made with a greater bottom portion or be made with a bottom portion having an increased width or area, for allowing the weights 20 to be supported on the supporting surface without the base 10. The rod 30 preferably includes two plates 39 for engaging with the weights 20 and for stably retaining or securing the weights 20 to the rod 30 (FIGS. 1, 4, 5). The weights 20 may also be made as the typical weight rings and engaged onto the blocks 31 or the rod 30, and selectively or adjustably secured to the rod 30 or the blocks 31 by the movable or adjustable latches 40. The weights 20 may thus be adjustably or selectively secured to the rod 30 by the latches 40.

Accordingly, the adjustable dumbbell in accordance with the present invention includes an easily and quickly adjustable structure.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. An adjustable dumbbell comprising:

a rod including a first end;

at least one weight engaged onto said first end of said rod; and a latch slidably engaged in said first end of said rod and movable to engage with said at least one weight for selectively securing said at least one weight to said first end of said rod;

wherein said at least one weight includes a groove formed therein for receiving said first end of said rod, said first end of said rod includes a pair of slots formed therein for receiving said at least one weight, said at least one weight includes a channel formed therein and communicating with said groove thereof and having a width greater than that of said groove of said at least one weight for receiving said latch, said first end of said rod includes a conduit formed therein for slidably receiving said latch, said first end of said rod includes a passage formed therein and communicating with said conduit thereof, said latch includes a fastener secured thereto and slidably engaged in said passage of said rod for moving said latch relative to said rod, said first end of said rod includes at least one aperture formed therein and communicating with said passage of said rod, and said latch further includes a barrel slidably engaged on said fastener and having a catch for engaging into said at least one aperture of said rod.

2. The adjustable dumbbell according to claim 1 further comprising means for biasing said catch of said barrel to engage with said at least one aperture of said rod.

3. The adjustable dumbbell according to claim 1, wherein said rod includes a second end, at least one second weight engaged onto said second end of said rod, and a second latch slidably engaged in said second end of said rod and movable to engage with said at least one second weight for selectively securing said at least one second weight to said second end of said rod.

4. The adjustable dumbbell according to claim 3, wherein said at least one second weight includes a groove formed therein for receiving said second end of said rod, said second end of said rod includes a pair of slots formed therein for receiving said at least one second weight.

5. The adjustable dumbbell according to claim 4, wherein said at least one second weight includes a channel formed therein and communicating with said groove thereof and having a width greater than that of said groove of said at least one second weight, for receiving said second latch.

6. The adjustable dumbbell according to claim 3, wherein said second end of said rod includes a conduit formed therein for slidably receiving said second latch.

7. The adjustable dumbbell according to claim 1, wherein said second end of said rod includes a passage formed therein and communicating with said conduit thereof, said second latch includes a fastener secured thereto and slidably engaged in said passage of said rod for moving said second latch relative to said rod.

8. The adjustable dumbbell according to claim 7, wherein said second end of said rod includes at least one second aperture formed therein and communicating with said passage of said rod, said second latch further includes a barrel slidably engaged on said fastener and having a catch for engaging into said at least one second aperture of said rod.

9. The adjustable dumbbell according to claim 8 further comprising means for biasing said catch of said barrel to engage with said at least one second aperture of said rod.

10. The adjustable dumbbell according to claim 1 further comprising means for supporting said at least one weight.

11. The adjustable dumbbell according to claim 10, wherein said supporting means includes a base having at least one socket recess formed therein for receiving and supporting said at least one weight.

12. The adjustable dumbbell according to claim 11, wherein said base includes at least one pair of walls provided therein for defining said at least one socket recess therein.

* * * * *